US006413137B1

(12) United States Patent
Myers, Sr.

(10) Patent No.: US 6,413,137 B1
(45) Date of Patent: Jul. 2, 2002

(54) ENTERTAINING ATTACHMENT FOR AN INFANT'S NURSING BOTTLE

(76) Inventor: Jermaine A. Myers, Sr., 689 Lovers La., Akron, OH (US) 44306

( * ) Notice: Subject to any disclaimer, the term of this patent is extended or adjusted under 35 U.S.C. 154(b) by 0 days.

(21) Appl. No.: 09/775,484

(22) Filed: Feb. 2, 2001

(51) Int. Cl.[7] ..... A61J 9/00; A63H 5/00; A63H 33/22

(52) U.S. Cl. ..... 446/77; 446/242; 446/404; 215/11.1

(58) Field of Search ..... 215/11.1; 446/74, 446/77, 219, 227, 236, 242, 397, 404

(56) References Cited

U.S. PATENT DOCUMENTS

| | | | | |
|---|---|---|---|---|
| 3,627,161 A | | 12/1971 | Wergeland | |
| 4,678,093 A | | 7/1987 | Allen | |
| 5,125,866 A | | 6/1992 | Arad et al. | |
| 5,344,034 A | | 9/1994 | Eagan | |
| 5,489,893 A | | 2/1996 | Jo et al. | |
| 5,664,745 A | | 9/1997 | Hadaway | |
| 5,842,901 A | | 12/1998 | Montgomery | |
| 6,024,625 A | | 2/2000 | Pearce | |
| 6,037,872 A | | 3/2000 | Dunnum | |
| 6,158,870 A | * | 12/2000 | Ramirez | 215/11.1 X |

* cited by examiner

*Primary Examiner*—John A. Ricci
(74) *Attorney, Agent, or Firm*—John D. Gugliotta

(57) ABSTRACT

A baby bottle for feeding purposes is provided with an attachable music box, light source and carousel-type motion display.

9 Claims, 2 Drawing Sheets

ENTERTAINING ATTACHMENT FOR AN INFANT'S NURSING BOTTLE

RELATED APPLICATIONS

The present invention was first described in Disclosure Document Number 476,640 filed on Jul. 7, 2000. There are no previously filed, nor currently any co-pending applications, anywhere in the world.

BACKGROUND OF THE INVENTION

1. Field of the Invention

The present invention relates generally to nursing bottles and nipples and the like and, more particularly, to an attachment to a nursing bottle that provides entertaining lights and sounds.

2. Description of the Related Art

While caring for a newborn baby can be one of the most rewarding duties a person may bear, it is often one of the most traumatizing. This is due to the fact that people know so very little about newborns due to the amount of time they are exposed to them. Perhaps the most traumatizing of these tasks is trying to get the infant to eat or sleep. Singing, feeding, rocking, and holding all may work at one time or another, but then again, they may not. Even if they do work, they require time and effort on the part of the care giver that the care giver may not be able to spare at that present time.

A search of the prior art did not disclose any patents that read directly on the claims of the instant invention; however, the following references were considered related.

The following patents disclose a sound-generating feeding bottle for babies.

U.S. Pat. No. 6,037,872 issued in the name of Dunnum

U.S. Pat. No. 6,024,625 issued in the name of Pearce

U.S. Pat. No. 5,489,893 issued in the name of Jo et al.

U.S. Pat. No. 4,678,093 issued in the name of Allen

U.S. Pat. No. 3,627,161 issued in the name of Wergeland

The following patents describe a musical baby bottle adapter.

U.S. Pat. No. 5,664,745 issued in the name of Hadaway

U.S. Pat. No. 5,344,034 issued in the name of Eagan

U.S. Pat. No. 5,842,901 issued in the name of Montgomery discloses a baby bottle with musical and vibratory adapters.

And, U.S. Pat. No. 5,125,866 issued in the name of Arad et al. describes an electric sound-generating simulated baby bottle toy.

Consequently, there is a need for a means by which infants, babies, and young children can be soothed to sleep or eat in a manner that is quick, easy and effective while requiring minimum effort on the part of the care giver.

SUMMARY OF THE INVENTION

It is therefore an object of the present invention to provide an improved entertaining attachment for an infant's nursing bottle.

It is a feature of the present invention to provide an improved entertaining attachment for an infant's nursing bottle that provides lights and music when wound up.

Briefly described according to one embodiment of the present invention, a baby bottle for feeding purposes is provided with an attachable music box, light source and carousel-type motion display. The upper portion of the invention strongly resembles a conventional baby bottle with a plastic bottle portion, a nipple, a nipple retaining collar, and a covering cap. The bottom surface of the bottle is threaded around the perimeter to allow for the attached of a disc shaped enclosure. The disc shaped enclosure contains a battery, a musical producing electronic chip, a light source, and a carousel-type rotary mechanism that provides for the movement of a see-thru plastic piece around the perimeter. The see-thru plastic piece is decorated with child-type images. The electronics are activated by a motion type switch, and thus are deactivated when the bottle is still for a period of time to conserve battery life. When the infant is feeding from the bottle, he or she will be soothed by the musical sound and the varying patterns illuminated by the interior light.

The use of the present invention allows for the soothing and entertainment of a feeding baby or child in an effective manner such that the baby or child will feed of fall asleep without a fuss.

An advantage of the use of standard sized components such as nipples, caps, etc. ensures compatibility with existing bottles.

Use of a combined Light, Sound and Motion Cap allows attachment to the Base of an otherwise conventional Baby Bottle.

Also, providing of an outside surface rotates with music to further entertain infant that will play for a predetermined period of time upon activation by a motion switch.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
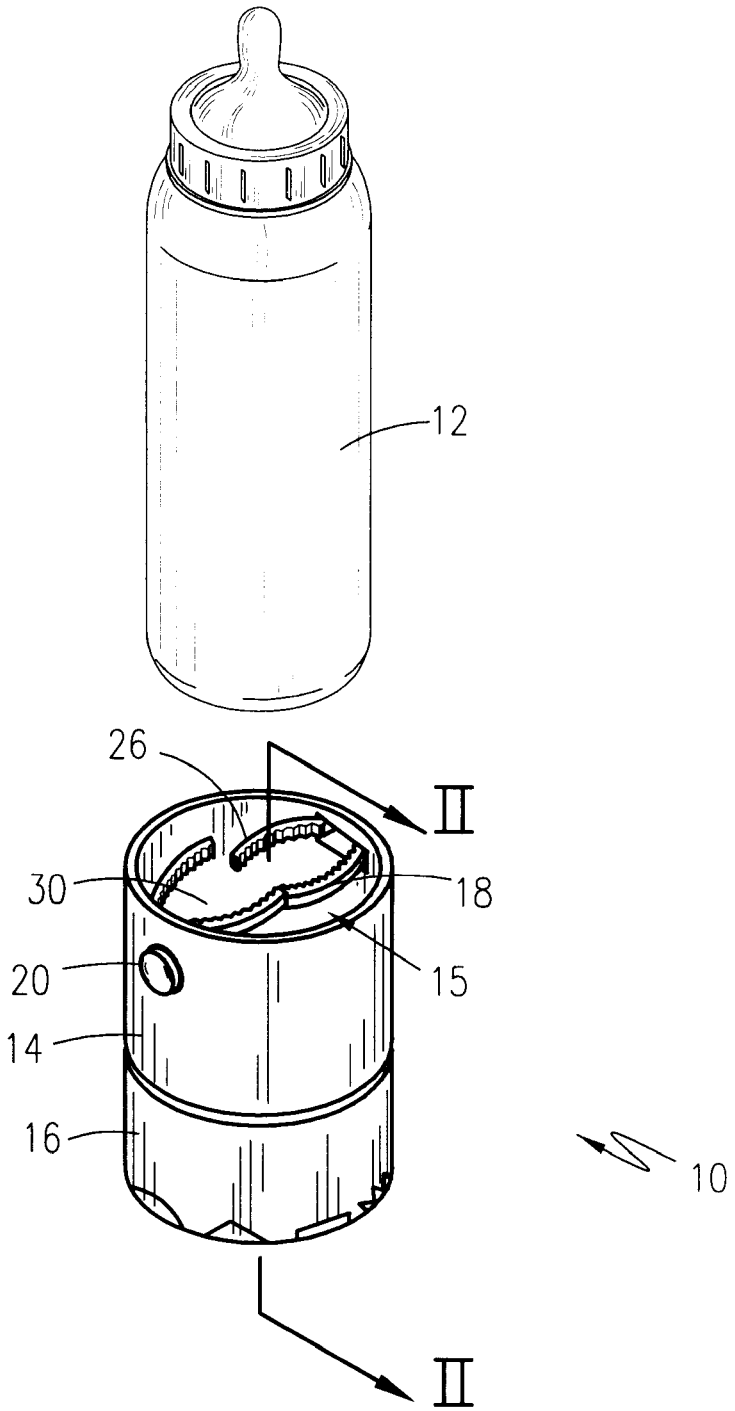
FIG. 1 is a perspective view of an attachment to a nursing bottle that provides entertaining lights and sounds according to the preferred embodiment of the present invention.
Figure 2:
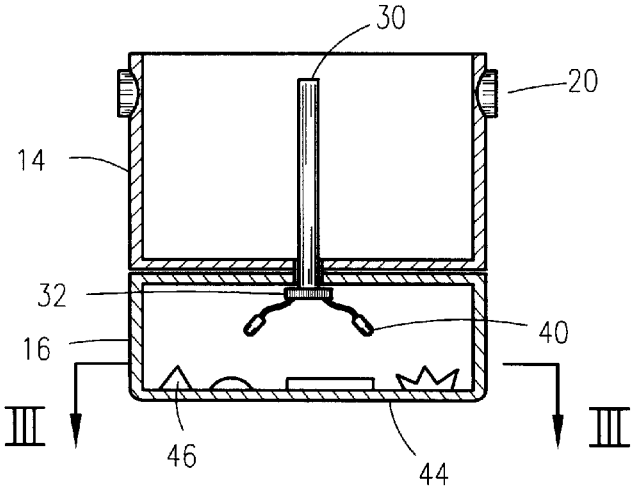
FIG. 2 is a cross sectional side elevational view taken along line II—II of FIG. 1.
Figure 3:
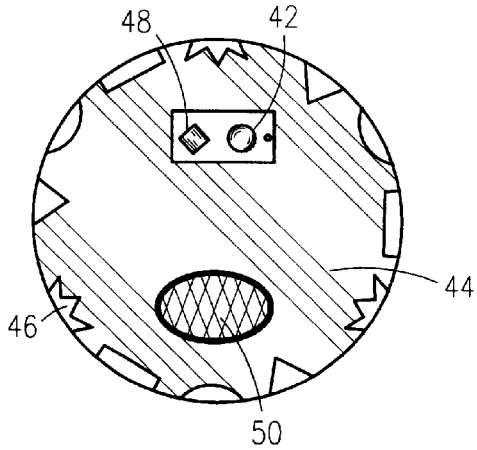
FIG. 3 is a cross sectional top plan view taken along line III—III of FIG. 2.
Figure 4:
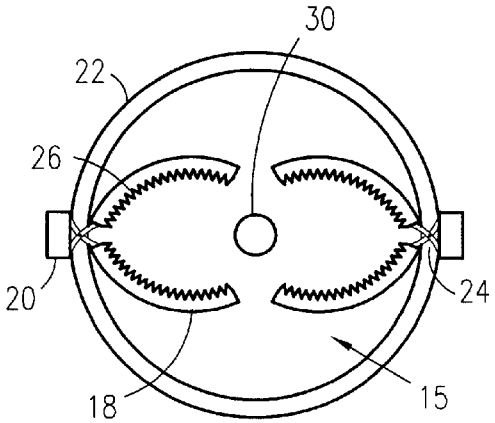
FIG. 4 is a top plan view of the an attachment to a nursing bottle of FIG. 1.

Referring now to FIGS. 1–4, an entertaining attachment apparatus 10 is shown, according to the present invention, for frictional attachment to the lower portion of an otherwise conventional infant's nursing bottle 12. The entertaining attachment apparatus 10 includes an upper attachment housing 14 rotatably affixed and axially aligned with a lower musical housing 16. The upper attachment housing 14 forms a cylindrical inner cavity 15 retains attachment clamps 18 circumscribe the lower periphery of the infant's nursing bottle 12 for providing firm mechanical attachment. The clamps 18 are in mechanical communication with a pair of opposed clamp buttons 20 accessible through the outer sidewall 22 of the housing 14. When the buttons 20 are depressed, the clamps 18 are forced radially outward for providing access to the cavity 15 by the bottle 12. When pressure in removed form the buttons 20, a biasing spring 24 urges the clamps 16 back toward the radial center of the housing 14. Additionally, the inner attachment surface 26 of the clamps 18 are lined with a frictionally enhancing surface, such as a grippable rubber liner.

The lower musical housing 16 is rotatable affixed to the upper attachment housing 14 by a spindle post 30. Terminating the lower portion of the spindle post 30 is a crank wheel 32 that provides a radial urging spring that allows the musical housing 16 to rotate slowly, relative to the attachment housing 14 when torsionally rotated relative to each other. A plurality of light means 40, such as bulbs or light emitting diodes, are in electrical communication with a battery 42. The lower portion 44 of the musical housing 16 includes transparent lens. Additionally, a plurality of randomly shaped magnification elements 46 align the lense surface for throwing distorted light images when illuminated from behind by the lighting elements 40. Additionally, a solid state memory device 48 stores and transmits music impulses to a speaker 50 for transmitting audible sound from the memory 48.

Additionally, it is envisioned that graphical images can be deposited upon the lens 44 around the lower peripheral rim of the lower housing 16. In this manner, shadows and images can be projected with the use of back lighting by the illumination source 40.

2. Operation of the Preferred Embodiment

In accordance with a preferred embodiment of the present invention, as shown in the figures, to use the present invention one merely fictionally impinges the entertaining attachment apparatus 10 to the lower portion of an otherwise conventional infant's nursing bottle 12. By twisting the lower housing 16, lights, shadows, and music can be generated from the lower portion of the bottle, thereby entertaining a feeding infant.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. An entertaining attachment apparatus for attachment to the lower portion of an otherwise conventional infant's nursing bottle, said entertaining attachment apparatus comprising:

a lower musical housing;

an upper attachment housing rotatably affixed and axially aligned with said lower musical housing, said upper attachment housing forming a cylindrical inner cavity;

attachment clamps within said cylindrical inner cavity for circumscribing a lower periphery of said infant's nursing bottle for providing firm mechanical attachment.

2. The entertaining attachment apparatus of claim 1, wherein said clamps are in mechanical communication with a pair of opposed clamp buttons accessible through an outer sidewall of said housing; wherein when said buttons are depressed, said clamps are forced radially outward for providing access to said cavity by said bottle; and a biasing spring for urging said clamps ack toward a radial center of said housing when pressure in removed from said buttons.

3. The entertaining attachment apparatus of claim 2, wherein inner attachment surface of said clamps are lined with a frictionally enhancing surface.

4. The entertaining attachment apparatus of claim 1, wherein said lower musical housing is rotatable affixed to said upper attachment housing by a spindle post, and terminating a lower portion of said spindle post is a crank wheel that provides a radial urging spring that allows said musical housing to rotate relative to said attachment housing when torsionally rotated.

5. The entertaining attachment apparatus of claim 1, further comprising a plurality of light means in electrical communication with a battery.

6. The entertaining attachment apparatus of claim 5, wherein a lower portion of said musical housing further comprises a transparent lens.

7. The entertaining attachment apparatus of claim 6, further comprising a plurality of randomly shaped magnification elements align with a surface of said lense for throwing distorted light images when illuminated from behind by said light means.

8. The entertaining attachment apparatus of claim 7, further comprising graphical images deposited upon said lens around a lower peripheral rim of said lower housing.

9. The entertaining attachment apparatus of claim 6, further comprising a solid state memory device for storing and transmitting music impulses to a speaker for transmitting audible sound from a memory.

* * * * *